US007823430B2

(12) United States Patent
Hammar et al.

(10) Patent No.: US 7,823,430 B2
(45) Date of Patent: Nov. 2, 2010

(54) OPEN PRESS THERMAL GAP FOR QPF FORMING TOOLS

(75) Inventors: Richard H. Hammar, Utica, MI (US); Richard M. Kleber, Clarkston, MI (US); Gary A. Kruger, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 269 days.

(21) Appl. No.: 12/181,538

(22) Filed: Jul. 29, 2008

(65) Prior Publication Data

US 2010/0024502 A1 Feb. 4, 2010

(51) Int. Cl.
*B21D 37/16* (2006.01)
*B21D 26/02* (2006.01)

(52) U.S. Cl. ..... 72/57; 72/60; 72/342.7; 72/446; 29/421.1

(58) Field of Classification Search ..... 72/57, 72/58, 60, 61, 63, 342.7, 342.8, 342.96, 347, 72/350, 446, 448; 29/421.1
See application file for complete search history.

(56) References Cited

U.S. PATENT DOCUMENTS 4,090,389 A * 5/1978 Van Denderen et al. ..... 72/350
5,272,898 A * 12/1993 Dittlo et al. ..... 72/57
6,237,381 B1 * 5/2001 Smedberg et al. ..... 72/19.9
6,578,400 B1 * 6/2003 Bonny et al. ..... 72/58
6,804,983 B2 * 10/2004 Mori et al. ..... 72/350
6,810,709 B2 * 11/2004 Hammar et al. ..... 72/342.7
7,004,007 B2 2/2006 Kruger et al.
7,080,535 B2 * 7/2006 Kruger et al. ..... 72/57
7,210,323 B2 * 5/2007 Kruger et al. ..... 72/57
7,472,572 B2 * 1/2009 Luckey et al. ..... 72/57
7,578,223 B2 * 8/2009 Bliss ..... 72/446
2007/0125145 A1 * 6/2007 Gomez ..... 72/55
2008/0282757 A1 * 11/2008 Lai et al. ..... 72/57

OTHER PUBLICATIONS

Quick Plastic Forming Makes Vehicle's Lift Gate Lighter, Society of Manufacturing Engineers, 1 page.

* cited by examiner

*Primary Examiner*—David B Jones
(74) *Attorney, Agent, or Firm*—Reising Ethington P.C.

(57) ABSTRACT

A quick plastic forming (QPF) tool is provided in which a thermal gap is created that reduces or eliminates some of the conductive heat loss paths when the QPF tool is in an open position during part removal or sheet loading. By reducing conductive heat loss, a more precise temperature control for the QPF tool from manufacturing cycle to manufacturing cycle may be realized. The QPF tool may also have a thermal gap when the tool is placed in a semi-open position during idle times. The QPF tool may also include components for creating the thermal gap when the QPF tool is moved to the open position and control the lateral movement of the part forming section of the QPF tool as the part is moved between the open position and the closed position.

31 Claims, 3 Drawing Sheets

OPEN PRESS THERMAL GAP FOR QPF FORMING TOOLS

TECHNICAL FIELD

The field generally relates to tools for hot forming of certain light weight sheet metal alloys. More specifically, the field pertains to the introduction of a thermal gap in a quick plastic forming tool to provide improved energy usage when the tool is in an open position.

BACKGROUND OF THE INVENTION

Quick plastic forming (QPF) generally represents a process in which a relatively thin sheet metal workpiece is forced into conformance with a forming surface of a forming tool by a pressurized gas. Suitable sheet metal workpieces utilized in such hot blow forming processes are generally only about a millimeter to a few millimeters in thickness and are composed of materials capable of undergoing high deformation (sometimes superplastic deformation) such as known aluminum and magnesium alloys.

SUMMARY OF THE INVENTION

One exemplary embodiment may include the introduction of a thermal gap for a QPF tool that is created between the forming section of the QPF tool and the remainder of the associated components that may reduce or eliminate some of the conductive heat loss paths when the QPF tool is in an open position during part remove or sheet loading. By reducing conductive heat loss when the tool is in an open position, a more precise control for the QPF tool from manufacturing cycle to manufacturing cycle may be realized.

Another exemplary embodiment also includes, in addition to the above-described thermal gaps, a mechanism by which the part forming portion of the forming section may be lifted as the QPF tool is moved to an open position to create one thermal gap for the QPF tool as described above.

Yet another exemplary embodiment may also include, in addition to the above-described thermal gaps, a mechanism by which the pressurization chamber portion and or the part forming portion of the forming section of the QPF tool may be stabilized in a lateral direction when the QPF tool is moved to an open position to create the thermal gaps described above.

These and other exemplary embodiments will become apparent from the present description.

DESCRIPTION OF EXEMPLARY EMBODIMENTS

The following description of the embodiment(s) is merely exemplary (illustrative) in nature and is in no way intended to limit the disclosure, its applications, or uses.

An improved apparatus and method for forming shaped parts from thin sheet metal workpieces, or blanks, within a quick plastic forming (QPF) tool is disclosed. To form the shaped parts generally, the blanks are loaded into the QPF tool when the QPF tool is in an open position. The tool is closed and the part is formed to its desired shape using a QPF forming process, in which hot air pressure and heat are utilize to conform the blank to an inner press surface of the part forming section of the QPF tool to form a part having a desired outer appearance. The QPF tool is then opened and the formed part is removed to complete one cycle, wherein the next blank is loaded into the QPF tool to begin the next cycle.

Figure 1A:
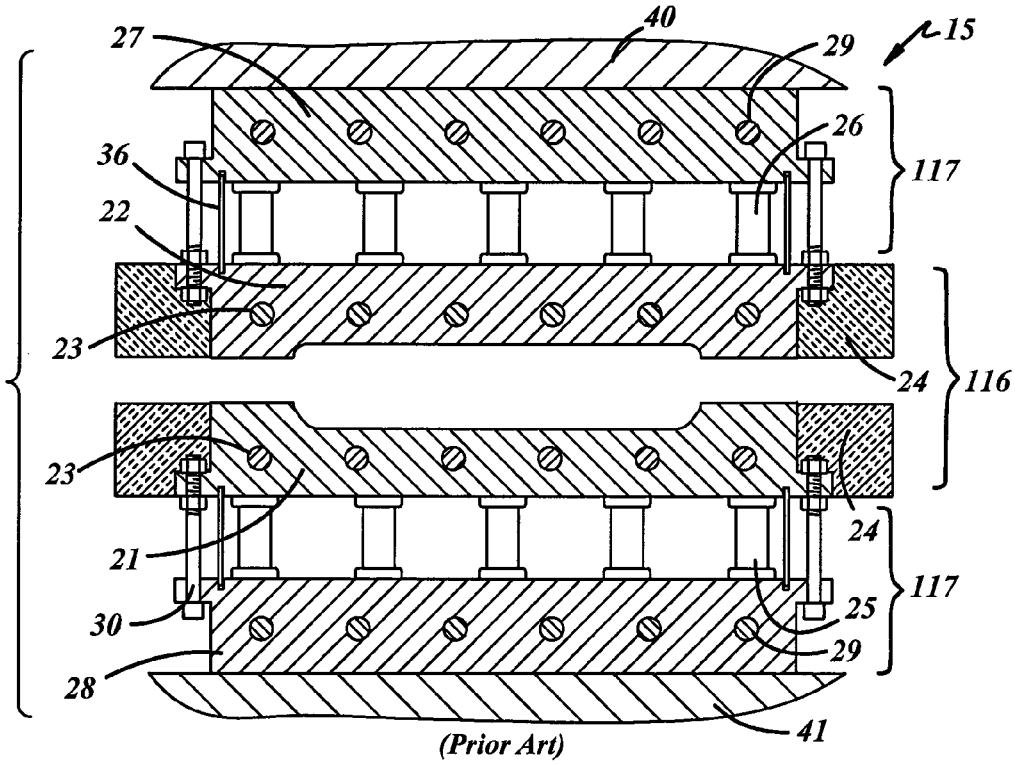
(Prior Art) FIG. 1A
FIGS. 1A and 1B illustrate a section view of a QPF tool in an open position and in a closed position according to the prior art.
Figure 1B:
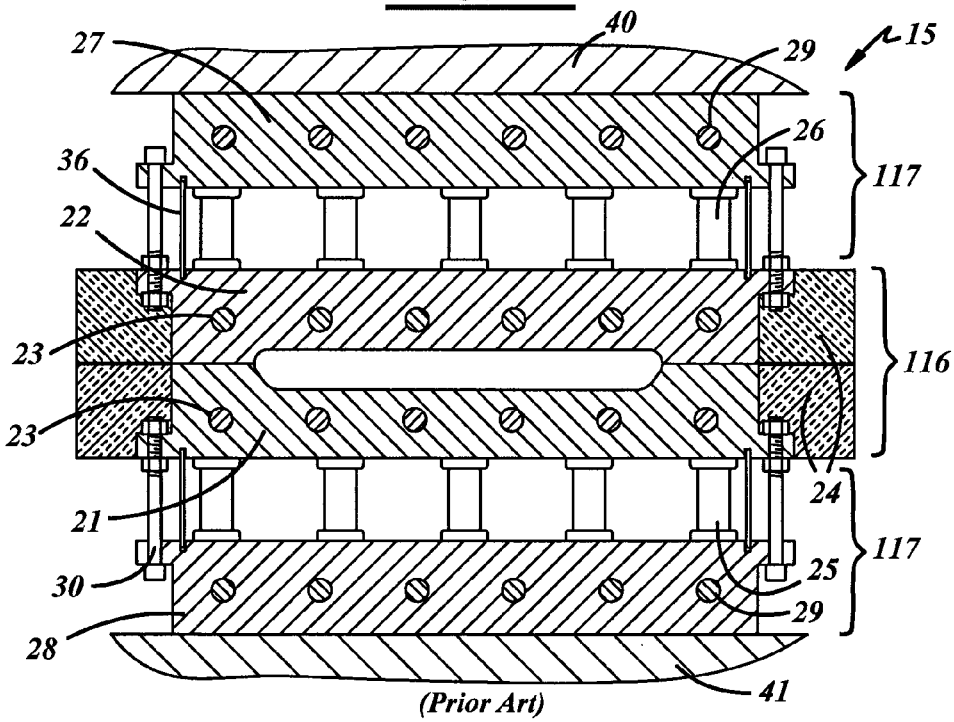
(Prior Art) FIG. 1B
Figure 2A:
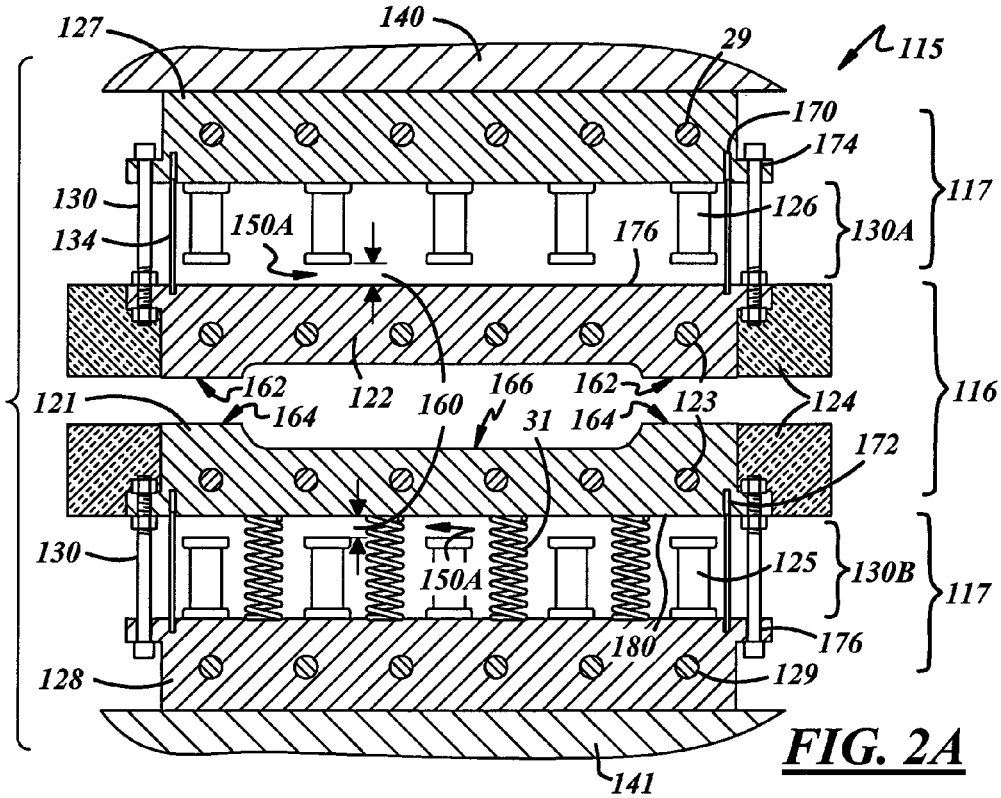
FIGS. 2A and 2B illustrate a section view of a QPF tool according to one exemplary embodiment in an open position and in a closed position.
Figure 2B:
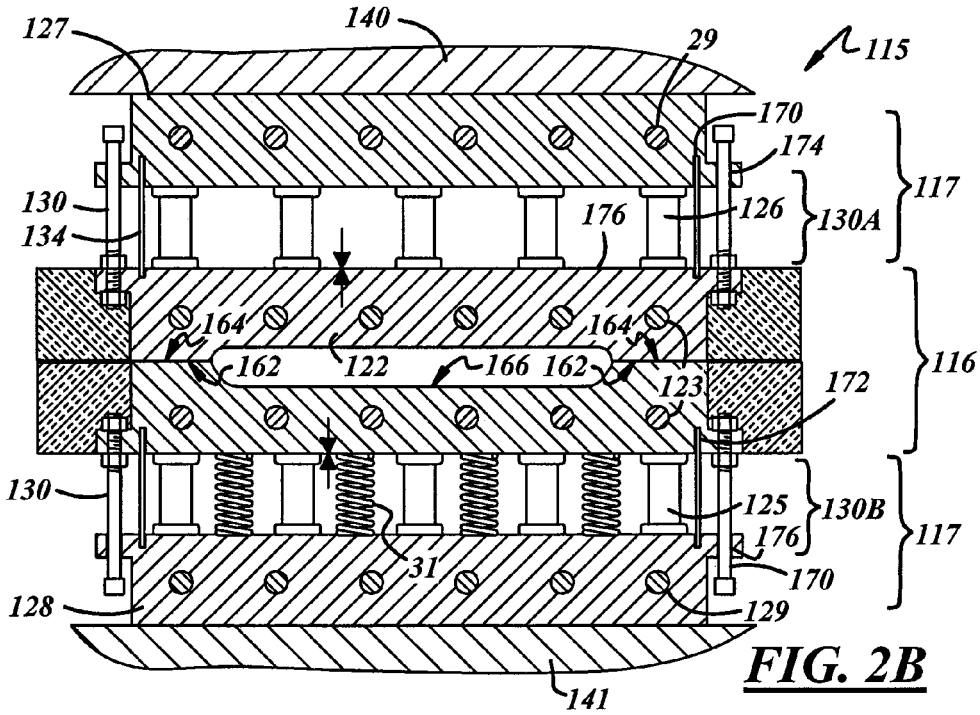

The QPF tool 15 according to the prior art and the QPF tool 115 according to one exemplary embodiment are illustrated in an open position (FIGS. 1A and 2A, respectively) and in a closed position (FIGS. 1B and 2B, respectively). The open position, as one of ordinary skill recognizes, is a position that allows the blank to be introduced to the QPF and wherein the formed part can be removed from the QPF, while the closed position is a position wherein the blank is converted to a formed part by the QPF tool.

The QPF tool 15 or 115 may include generally a part forming section 116, wherein the blank is physically loaded and transformed to a formed part, and a press section 117, which includes all the associated components for moving the QPF tool 15 or 115 between the open position and closed position and other components not directly related to the movement but associated with the QPF tool 15 or 115.

The part forming section 116 includes a part forming portion 121 and the pressurized chamber portion 122 that both may have structures, such as internal electrical heating elements 123 as shown in this exemplary embodiment, to maintain the elevated forming temperature of the process. The part forming portion 121 and the pressurized chamber portion 122 may be both surrounded by an insulating layer 124 and sliding sheets 134. A first set 130A of adjustable tension rods 130 may be secured to pressurized chamber portion 122 and may be slidingly coupled within an upper load plate 127. A second set 130B of adjustable tension rods 130 may be secured to the part forming portion 122 and may be slidingly coupled within a lower load plate 128. The adjustable tension rods 130 may support the mass of the part forming portion 121 and the pressurized chamber portion 122 while the tool 115 is in an open position as shown in FIG. 2A. The upper load plate 127 may also be coupled to an upper press platen 140, while the lower load plate 128 may also be similarly coupled to a lower press platen 141.

In addition, one or more load posts 126 may be coupled between the pressurized chamber portion 122 and the upper load plate 127. Similarly, one or more load posts 125 may be coupled between the part forming portion 121 and the lower load plate 128. The upper load post 126 may be affixed to the upper load plate 127 and the lower load post 125 may be affixed to the lower load plate 128 using a threaded bolt (shown as 188 in FIG. 4). Moreover, in the prior art as shown in FIGS. 1A and 1B, the upper and lower load posts 125, 126 may also be affixed or otherwise permanently coupled in close proximity to the pressurized chamber portion 122 and part forming portion 121, respectively.

The load posts 125, 126 may also be used to reduce the area of conductive heat transfer from the heated part forming portion 121 and the pressurization chamber portion 122 to the upper load plate 127 and to the lower load plate 128 when the tool is in the closed position. To further reduce heat transfer to the upper press platen 140 and the lower press platen 141, the upper load plate 127 and the lower load plate 128 may have internal passages 129 through which a cooling fluid (not shown) is circulated. Heat energy may be dissipated into the atmosphere as the cooling fluid is circulated through a chiller mechanism or heat exchanger (not shown).

In the exemplary embodiment as shown in FIGS. 2A and 2B, one or more compressive springs 131 may also be coupled between the part forming portion 121 and the lower load plate 128. As shown in FIGS. 2A and 2B, a single compressive spring 131 may be located between each respective pair of lower load posts 126, although alternative exemplary arrangements could alter either the location of the compressive springs 131 relative to the lower load posts 126, or the number of compressive springs 131, or both the location and number of compressive springs 131, and is thus not limited to the exemplary arrangement as shown in FIGS. 2A and 2B. Moreover, the relative size of the compressive springs 131 and the material choice of the springs 131, here shown as metal springs, and hence the force necessary to compress the spring 131, may vary from the exemplary arrangement as shown in FIGS. 2A and 2B.

To form the formed part from the blank in accordance with either the prior art of with the exemplary embodiment as described above, the QPF tool 15 or 115 may first be placed in an open position, as shown in FIGS. 1A and 2A. A blank (not shown) may then be loaded into the space 160 between the part forming portion 121 and the pressurization chamber portion 122. As further shown in FIG. 2A, a gap 150A between the pressurization chamber portion 122 and the upper load posts 126 may be formed when the tool 115 is in the open position. Similarly, a gap 150B between the heated part forming portion 121 and the lower load posts 125 may also be formed when the tool 115 is in the open position. Conversely, the QPF tool 15 in accordance with the prior art as illustrated FIGS. 1A and 1B does not form these associated gaps in the open position.

Next, the QPF tool 15 or 115 may be closed. To accomplish this, force may be applied to the upper press platen 140 in a direction towards the lower press platen 141 (shown as downward in FIGS. 1 and 2).

In the prior art, as shown in FIG. 1B, the movement of the upper press platen 140 causes the upper load plate 127, the coupled upper load posts 126, and the pressurization chamber to move downward until such time as the lower surface 162 of the pressurization chamber portion 122 is sealingly engaged to a corresponding upper surface 164 of the part forming portion 121, leaving the blank entirely contained within the gap 160 formed there between. In other words, each of the parts described above move simultaneously with one another. The QPF tool 15 is thus in the so-called closed position, as shown in FIG. 1B.

Conversely, as shown in the exemplary embodiment in FIG. 2B, the movement of the upper press platen 140 may cause the upper load plate 127 and coupled upper load posts 126 to move downward as well, wherein the sliding sheets 134 may move within their respective gaps 170 and wherein the tension rods may slide through the opening 174 within the upper load plate 127. Note again that no such gap 170 is present in the QPF tool 15 shown in FIGS. 1A and 1B. The upper load posts 126 may eventually contact an upper surface 176 of the pressurization chamber portion 122, therein moving the pressurization chamber portion 122 downward in response until such time as the until the lower surface 162 of the pressurization chamber portion 122 may be sealingly engaged to a corresponding upper surface 164 of the part forming portion 121, leaving the blank entirely contained within the gap 160 formed there between.

The continued force downward may then cause the part forming portion 21 to move downward as well, therein pushing the lower surface 180 of the part forming portion 21 against the springs 131 wherein the sliding sheets 134 move within their respective gaps 172 and wherein the tension rods slide through the opening 178 within the lower load plate 128. Note that no such gap is present in the QPF tool shown in FIGS. 1A and 1B. The distance between the lower surface 180 of the part forming portion and the lower load plate 127 may continue to decrease until the point wherein the lower load posts 125 contact the lower surface 180 of the part forming portion 121. This is the so-called closed position, as shown in FIG. 2B.

Next, in both the prior art as shown in FIG. 1 and as shown in FIG. 2, the internal electrical heating elements 123 heats the pressurization chamber portion 122 and part forming portion 121 to a desired forming temperature. At the same time, a gas such as pressurized air is introduced within the gap 160, thus pressing the blank against the inner surface 166 of the part forming portion 121 within the gap 160. The blank thus conforms to the shape of the inner surface 166 to form the finished part. As one of ordinary skill in metal forming appreciates, the desired forming temperature and air pressure, as well as the amount of time in which the QPF tool is closed, are determined as a function of the composition, thickness, and desired shape for the formed part.

While the QPF tool 15 or 115 is in the closed position, heat generated by the internal heating elements 123 to the pressurization chamber portion 122 may be conducted to the upper load plate 127 through the upper load posts 126. The heat may be partially dissipated by cooling fluid that flows through the internal passages 129 in the upper load plate 127. At the same time, heat generated by the internal heating elements 123 to the part forming portion 121 may be conducted to the lower load plate 128 through the lower load posts 125. The heat may be partially dissipated by cooling fluid that flows through the internal passages 129 in the lower load plate 128. Thus, a substantial portion of the heat may be dissipated before contacting the upper press platen 140 and lower press platen 141 and the upper load plate 127 and lower load plate 128 prior to reopening the QPF tool 15 or 115, which may protect workers loading blanks and unloading formed parts and may also protect sensitive equipment associated with the QPF tool.

The use of load posts 125 and 126 in either QPF tool 15 or 115 may also aid in maintaining precise temperature control substantially uniformly along the entirety of the pressurization chamber portion 122 and part forming portion 121. The load posts 125, 126 may function to reduce the area of conductive heat transfer from the pressurization chamber portion 122 and part forming portion 121 while the QPF tool 15 or 115 is closed as compared to prior art presses not utilizing load posts (i.e. wherein the load plates form a portion of the pressurization chamber portion and the part forming portion). Thus, more of the heat may be maintained uniformly along the part forming surfaces (here the pressurization chamber portion 122 and the part forming portion 121) to improve part consistency from cycle to cycle.

After the blank is formed into the finished part, the QPF tool 15 or 115 may be opened by moving the upper press platen 140 away from the lower press platen 141 (upward as shown in FIGS. 1A, 1B, 2A and 2B).

In the prior art as shown in FIGS. 1A and 1B, the movement of the upper press platen 140 causes the upper plate portion 127, the upper load posts 126, and the pressurization chamber portion 122 to move upward as well, therein unsealing the pressurization chamber portion 122 from the part forming portion 121 to expose the formed part conforming to the inner surface 166 of the part forming portion 121. The formed part is then removed, a blank is replaced, and the QPF tool 15 may be moved back to the closed position to form the next part.

Conversely, as shown in the exemplary embodiment of FIG. 2A, the force from the compressive springs 131 may be enough to lift the formed part and part forming portion 21 relative to the lower load plate 128, thereby recreating the gap 150B between the lower load post 127 and the lower surface 180. Similarly, the gap 150A may be recreated by the movement of the upper load posts 126 (coupled to the upper load plate 127 and upper press platen 140) away from the pressurization chamber portion 121. The first set 130A of adjustable tension rods 130 may control the relative size of the first gap 150A, while the second set 130B of adjustable tension rods 130 may control the relative size of the second gap 150B.

The movement of the respective load posts 125, 126 to create the afore-mentioned gaps 150A, 150B when the QPF tool 115 is in the open position may reduce the conductive heat paths from the pressurization chamber portion 122 and the part forming portion 121 to a few incidental component paths. Of course, the compressive springs 131 may provide an alternative path for heat transfer, but such a path contributes relatively smaller heat transfer than through the load posts, which has relatively larger surface areas through which to conduct heat. Given that the percentage of time that the QPF tool open may approach and exceed 50% of the manufacturing time (depending upon the configuration of the part formed), it is easy to appreciate that the pressurization chamber portion 122 and part forming portion 121 may retain substantially more heat than conventional QPF tools 15 such as that shown in FIG. 1A or 1B, wherein conductive heat continues to escape through the load posts 25, 26 even when the QPF tool 15 is in the open position. As such, operating costs, including energy costs associated with reheating the pressurization chamber portion 122 and part forming portion 121 to the desired forming temperature during the next closed cycle may be reduced. Moreover, reheating times to the desired forming temperature may also be reduced, with leads to increased productivity. In addition, energy costs for cooling the ancillary component parts (i.e. the upper load plate 127, the upper press platen 140, the lower load plate 128, and the lower press platen 140) may also be reduced.

In another alternative exemplary arrangement, the insulating layer 124 may be modified such that the QPF tool 115 can be held in a semi-open position, approximately midway between the open position and closed position, so that the gaps 150A and 150B may be maintained while the QPF tool 115 is idled (i.e. not being cycled to form parts from blanks). In this arrangement, the size of the gaps 150A, 150B may be smaller than when the QPF tool 115 is in the open position.

Figure 3:
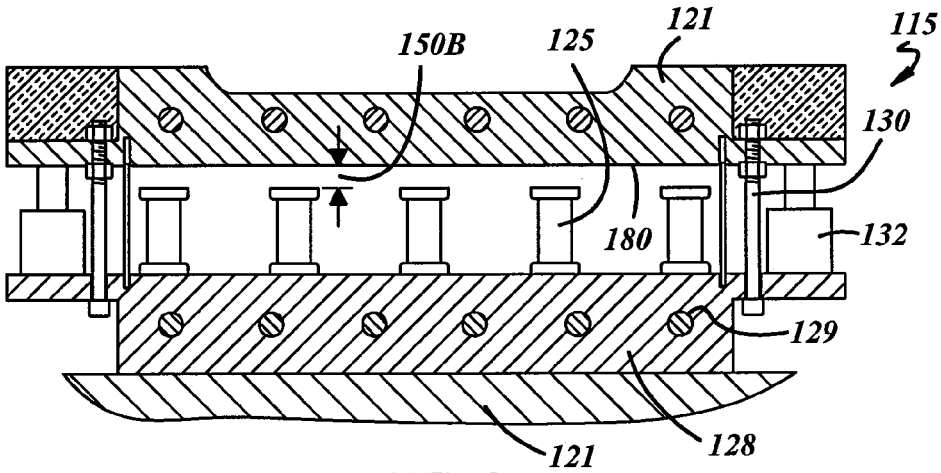
FIG. 3 illustrates a section view of a portion of a QPF tool in an open position according to another exemplary embodiment.

Referring now to FIG. 3, an alternative exemplary embodiment for creating the thermal gap 150A when the QPF forming tool 115 is in an open position is proposed, in which one or more pneumatic cylinders 132 may replace the one or more compressive springs 131 found in FIGS. 2A and 2B. The pneumatic cylinders 132 may provide lifting force to the lower surface 180 of the part forming portion 121 to create the gap 150B when the QPF tool 115 is opened from the closed position to the open position in a similar manner to the compressive springs 131 as described above with respect to FIGS. 2A and 2B. While two pneumatic cylinders located along the outer periphery between the part forming portion 121 and the lower plate portion 128 are depicted in FIG. 3, the number and location of the pneumatic cylinders is not limited to the proposed exemplary arrangement, but may take on a wide variety of different arrangements. Also, the relative size and shape of the pneumatic cylinder 132 may vary, as one of ordinary skill in the forming arts appreciates.

Figure 4A:
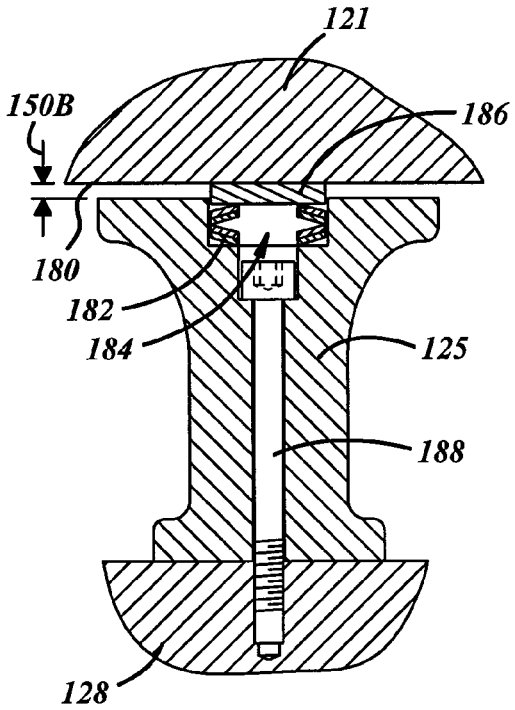
FIGS. 4A and 4B illustrate a section view of a portion of a QPF tool in an open position and a closed position according to yet another exemplary embodiment.
Figure 4B:
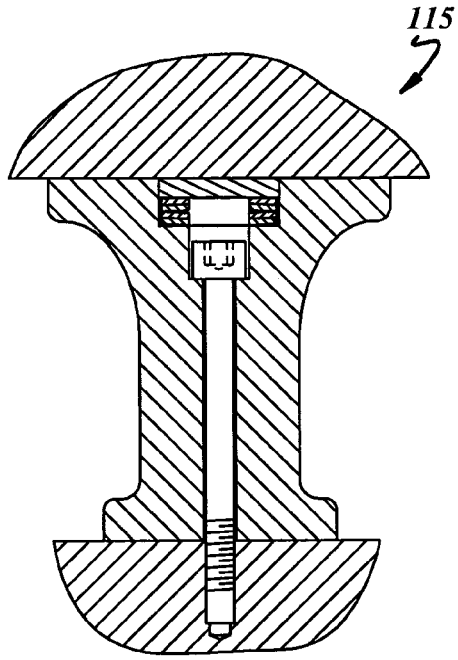

Referring now to FIGS. 4A and 4B, an alternative exemplary arrangement associated with the interaction of the lower load posts 125 with the part forming portion 121 is illustrated when the QPF tool 115 is in the open position and closed position.

As shown herein, a conical type washer spring 182 may be placed into a cylindrical recess 184 internal to the lower load posts 125 at a position above the threaded bolt 188. Additionally, a cylindrical protuberance 186, not physically attached to the part forming tool 21, may extend from the lower surface 180 of the part forming tool 121 within the confines of the cylindrical recess 184 internal to the lower load post 125.

The washer spring 182 may bridge the gap 150B formed when the QPF tool 115 is in the open position and are therefore designed to lift the part forming portion 121. In addition, the conical washer springs 182 and the cylindrical protuberance 186 provide sliding surfaces for the hot part forming portion 121.

The alternative exemplary embodiment provides a configuration therein that may offer control over the lateral movement (i.e. leftward or rightward movement as shown in FIGS. 4A and 4B) of the part forming portion 121 as the QPF tool 115 is moved from the open position, as shown in FIG. 4A, to the closed position, as shown in FIG. 4B, and back again, during a manufacturing cycle.

While not shown, the concept configuration of FIGS. 4A and 4B may also be utilized in substantially the same manner on the upper load posts 126 to provide control over lateral movement of the pressurization chamber portion 122 as the QPF tool 115 is cycled from the open position to the closed position and back to the open position. The method used for maintaining the relative positions of the hot and cool tool portions is described in U.S. Pat. No. 7,004,007 to Kruger et al., which is herein incorporated by reference.

In any of the exemplary embodiments shown in FIGS. 2-4, offers many benefits over prior art QPF tools, including the QPF tool 15 from the prior art that is shown in FIGS. 1A and 1B. For example, operating costs may be reduced by increasing heat retention within the QPF tool 115, thereby leading to reduced energy costs to maintain forming temperatures on a per cycle basis and over the lifetime of the QPF tool 115. In addition, because the QPF tool 115 may reach forming temperatures more quickly, reduced cycling time, and increased productivity, may result. Further, improved temperature control and temperature uniformity of part forming surfaces may improve part consistency. Also, energy costs for cooling ancillary components such as the press platens may be reduced. Along those lines, improved worker safety associated with the cooler ancillary components may also be realized. In another alternative exemplary embodiment (not shown), a soft insulating blanket may also be introduced between the hot and cold tool elements to further reduce heat transfer.

Practices of the disclosure have illustrated in the description of exemplary embodiments. But the scope of the disclosure is not limited to these illustrations.

The invention claimed is:

1. A product comprising:

a part forming section including a pressurization chamber portion coupled to a part forming portion, said pressurization chamber portion and said part forming portion defining an open position and a closed position there between;

an upper load plate slidingly coupled to said pressurization chamber portion;

a lower load plate slidingly coupled to said part forming portion;

one or more upper load posts coupled between said upper load plate and said pressurization chamber portion;

one or more lower load posts coupled between said lower load plate and said part forming portion;

wherein said one or more upper load posts are in thermal contact with a portion of said pressurization chamber portion and wherein said one or more lower load posts are in thermal contact with said part forming portion when the product is in the closed position; and wherein at least one of said one or more upper load posts are separated from said pressurization chamber portion by a first gap and wherein at least one of said one or more lower load posts are separated from said part forming portion by a second gap when the product is in said open position.

2. The product of claim 1 further comprising:

one or more compression springs located between said lower load plate and said part forming portion, said one or more compression springs sufficiently energizable to move said part forming portion away from said lower load plate to create said second gap when the product is moved from said closed position to said open position.

3. The product of claim 2, wherein said one or more compression springs comprises a plurality of compression springs.

4. The product of claim 3, wherein each of said plurality of compression springs is located between a corresponding pair of said one or more lower load posts, wherein said one or more lower load posts comprises a plurality of lower load posts.

5. The product of claim 1 further comprising one or more pneumatic cylinders located between said lower load plate and said part forming portion, said one or more pneumatic cylinders having sufficient lifting force to move said part forming portion away from said lower load plate to create said second gap when the product is moved from said closed position to said open position.

6. The product of claim 1 further comprising a cylindrical washer type spring coupled within a cylindrical recess located within at least one of said one or more lower load posts.

7. The product of claim 6 further comprising a cylindrical washer type spring coupled within a cylindrical recess located within at least one of said one or more upper load posts.

8. The product of claim 1 further comprising an upper press platen coupled to said upper load plate and a lower press platen coupled to said lower load plate.

9. The product of claim 1 further comprising one or more adjustable tension rods secured to said pressurization chamber portion and slidingly coupled to said upper load plate, said one or more adjustable tension rods controlling the size of said first gap when the product is in said open position.

10. The product of claim 1 further comprising one or more adjustable tension rods secured to said part forming portion and slidingly coupled to said lower load plate, said one or more adjustable tension rods controlling the size of said second gap when the product is in said open position.

11. The product of claim 1 further comprising:

one or more adjustable tension rods secured to said pressurization chamber portion and slidingly coupled to said upper load plate, said one or more adjustable tension rods controlling the size of said first gap when the product is in the open position; and one or more adjustable tension rods secured to said part forming portion and slidingly coupled to said lower load plate, said one or more adjustable tension rods controlling the size of said second gap when the product is in said open position.

12. A product comprising:

a part forming section including a pressurization chamber portion coupled to a part forming portion, said pressurization chamber portion and said part forming portion defining an open position and a closed position there between;

an upper load plate slidingly coupled to said pressurization chamber portion;

one or more upper load posts coupled between said upper load plate and said pressurization chamber portion;

wherein said one or more upper load posts are in thermal contact with a portion of said pressurization chamber portion when the product is in the closed position; and wherein at least one of said one or more upper load posts are separated from said pressurization chamber portion by a first gap when the product is in said open position.

13. The product of claim 12 further comprising one or more adjustable tension rods secured to said pressurization chamber portion and slidingly coupled to said upper load plate, said one or more adjustable tension rods controlling the size of said first gap when the product is in said open position.

14. A product comprising:

a part forming section including a pressurization chamber portion coupled to a part forming portion, said pressurization chamber portion and said part forming portion defining an open position and a closed position there between;

a lower load plate slidingly coupled to said part forming portion;

one or more lower load posts coupled between said lower load plate and said part forming portion;

wherein said one or more lower load posts are in thermal contact with said part forming portion when the product is in the closed position; and wherein at least one of said one or more lower load posts are separated from said pressurization chamber portion by a first gap when the product is in said open position.

15. The product of claim 14 further comprising one or more adjustable tension rods secured to said part forming portion and slidingly coupled to said lower load plate, said one or more adjustable tension rods controlling the size of said first gap when the product is in said open position.

16. The product of claim 14 further comprising:

one or more compression springs located between said lower load plate and said part forming portion, said one or more compression springs sufficiently energizable to move said part forming portion away from said lower load plate to create said second gap when the product is moved from said closed position to said open position.

17. The product of claim 16, wherein said one or more compression springs comprises a plurality of compression springs.

18. The product of claim 17, wherein each of said plurality of compression springs is located between a corresponding pair of said one or more lower load posts, wherein said one or more lower load posts comprises a plurality of lower load posts.

19. The product of claim 14 further comprising one or more pneumatic cylinders located between said lower load plate and said part forming portion, said one or more pneumatic cylinders having sufficient lifting force to move said part forming portion away from said lower load plate to create said second gap when the product is moved from said closed position to said open position.

20. The product of claim 14 further comprising a cylindrical washer type spring coupled within cylindrical recess located within at least one of said one or more lower load posts.

21. A method for forming a formed part from a blank, the method comprising:

(a) providing a product comprising:

a forming section including a pressurization chamber portion coupled to a part forming portion, said pressurization chamber portion and said part forming portion defining an open position and a closed position there between;

an upper load plate slidingly coupled to said pressurization chamber portion;

a lower load plate slidingly coupled to said part forming portion;

one or more upper load posts coupled between said upper load plate and said pressurization chamber portion;

one or more lower load posts coupled between said lower load plate and said part forming portion;

(b) introducing the blank between said pressurization chamber portion and said part forming portion when the product is in said open position;

(c) closing said product from said open position to said closed position such that the blank is located within a gap between said pressurization chamber portion and said part forming portion, wherein the movement of said product to said closed position places said one or more upper load posts in thermal contact with a portion of said pressurization chamber portion and wherein the movement of said product causes said one or more lower load posts to be moved in thermal contact with said part forming portion;

(d) forming the formed part from the blank within said gap when said product is in said closed position;

(e) opening said product from said closed position to said open position; wherein the movement of said product to said open position causes said one or more upper load posts to separate from said portion of said pressurization chamber portion by a first gap and wherein the movement of said product causes said one or more lower load posts to separate from a portion of said part forming portion by a second gap; and (f) removing the formed part from said inner surface.

22. The method of claim 21, wherein said product further comprises one or more compression springs located between said lower load plate and said part forming portion, said one or more compression springs sufficiently energizable to move said part forming portion away from said lower load plate to create said second gap when the product is moved from said closed position to said open position.

23. The method of claim 21, wherein said product further comprises one or more pneumatic cylinders located between said lower load plate and said part forming portion, said one or more pneumatic cylinders having sufficient lifting force to move said part forming portion away from said lower load plate to create said second gap when the product is moved from said closed position to said open position.

24. The method of claim 21, wherein said product further comprises a cylindrical washer type spring coupled within a cylindrical recess located within at least one of said one or more lower load posts.

25. The method of claim 24, wherein said product further comprises a cylindrical washer type spring coupled within a cylindrical recess located within at least one of said one or more upper load posts.

26. A product comprising:

a part forming section defining an open position and a closed position there within;

a press section coupled to said part forming section and moving said part forming section between said open position and said closed position, said press section including one or more load posts;

wherein said one or more load posts are in thermal contact with a portion of said part forming section when the product is in the closed position; and wherein at least one of said one or more load posts are separated from said part forming section by a first gap when the product is in said open position.

27. A product comprising:

a part forming section including a pressurization chamber portion coupled to a part forming portion, said pressurization chamber portion and said part forming portion defining an open position and a closed position there between;

an upper load plate slidingly coupled to said pressurization chamber portion;

a lower load plate slidingly coupled to said part forming portion;

one or more upper load posts coupled between said upper load plate and said pressurization chamber portion, said one or more upper load posts constructed to be moveable from an first position, wherein said upper load posts are in thermal contact with said pressurization chamber portion, to a second position, wherein said upper load posts are not in thermal contact with said pressurization chamber portion; and one or more lower load posts coupled between said lower load plate and said part forming portion, said one or more lower load posts constructed to be moveable from a first position, wherein said lower load posts are in thermal contact with said part forming portion, to a second position, wherein said lower load posts are not in thermal contact with said part forming portion.

28. A product comprising:

a part forming section including a pressurization chamber portion coupled to a part forming portion, said pressurization chamber portion and said part forming portion defining an open position and a closed position there between;

an upper load plate slidingly coupled to said pressurization chamber portion;

one or more upper load posts coupled between said upper load plate and said pressurization chamber portion, said one or more upper load posts constructed to be moveable from an first position, wherein said upper load posts are in thermal contact with said pressurization chamber portion, to a second position, wherein said upper load posts are not in thermal contact with said pressurization chamber portion.

29. A product comprising:

a part forming section including a pressurization chamber portion coupled to a part forming portion, said pressurization chamber portion and said part forming portion defining an open position and a closed position there between;

a lower load plate slidingly coupled to said part forming portion;

one or more lower load posts coupled between said lower load plate and said part forming portion, said one or more lower load posts constructed to be moveable from a first position, wherein said lower load posts are in thermal contact with said part forming portion, to a second position, wherein said lower load posts are not in thermal contact with said part forming portion.

30. A method for reducing conductive heat loss in a quick plastic forming tool when the tool is in an open position, the method comprising:

providing one or more lower load posts coupled between a lower load plate and a part forming portion of the quick plastic forming tool, said one or more lower load posts constructed to be moveable from a first position, wherein said lower load posts are in thermal contact with said part forming portion, to a second position, wherein said lower load posts are not in thermal contact with said part forming portion; and moving said one or more lower load posts to said second position when the tool is in the open position.

31. A method for reducing conductive heat loss in a quick plastic forming tool when the tool is in an open position, the method comprising:

providing one or more upper load posts coupled between an upper load plate and a pressurization chamber portion of the quick plastic forming tool, said one or more upper load posts constructed to be moveable from an first position, wherein said upper load posts are in thermal contact with said pressurization chamber portion, to a second position, wherein said upper load posts are not in thermal contact with said pressurization chamber portion; and moving said one or more upper load posts to said second position when the tool is in the open position.

* * * * *